United States Patent [19]

Matzkin et al.

[11] Patent Number: 4,505,504

[45] Date of Patent: Mar. 19, 1985

[54] DOOR LOCK COVER

[76] Inventors: Harry Matzkin, 34 Interlaken Dr., Eastchester, N.Y. 10709; Leslie Getto, 416 E. 174th St., Bronx, N.Y. 10457

[21] Appl. No.: 564,715

[22] Filed: Dec. 23, 1983

[51] Int. Cl.[3] ..... E05C 1/16

[52] U.S. Cl. ..... 292/337

[58] Field of Search ..... 292/337, 175, 169 R, 292/169.13, 169.19, 169.21, 169.22, 169.23

[56] References Cited

U.S. PATENT DOCUMENTS

| | | | |
|---|---|---|---|
| 180,894 | 8/1876 | Leach . | |
| 231,608 | 8/1880 | Parker . | |
| 1,483,333 | 2/1924 | Capece | 452/502 |
| 2,263,772 | 11/1941 | Gold | 70/451 |
| 2,413,732 | 1/1947 | Schlage | 292/337 |
| 2,538,688 | 1/1951 | Heyer | 292/337 |
| 3,673,605 | 6/1972 | Allenbaugh | 292/346 |
| 4,139,999 | 2/1979 | Allenbaugh | 292/337 X |

FOREIGN PATENT DOCUMENTS 1011308 6/1952 France .

1481984 1/1966 France .

*Primary Examiner*—Richard E. Moore

*Attorney, Agent, or Firm*—Charles E. Temko

[57] ABSTRACT

An improved door lock cover of a type including a centrally disposed web and a pair of side plates. The web has a generally rectangular medially disposed opening to accommodate the normally exposed end plate forming a part of a door lock. Extending into the opening at the sides thereof, there are a pair of longitudinally oriented curved flanges forming channels. An extruded plate underlies the opening and has corresponding flanges engaging the channels, the ends of the plate contacting the transverse sides of the opening which may also be bordered by flanges. The transverse sides of the opening are also provided with tab-like extensions which are bendable to engage a rear surface of the plate and retain it in position. In a second embodiment, the tabs are substituted by screw fasteners which penetrate the web and engage ends of a slightly longer plate. In a third form, the tabs and screws are substituted by an epoxy adhesive.

4 Claims, 6 Drawing Figures

FIG. 1
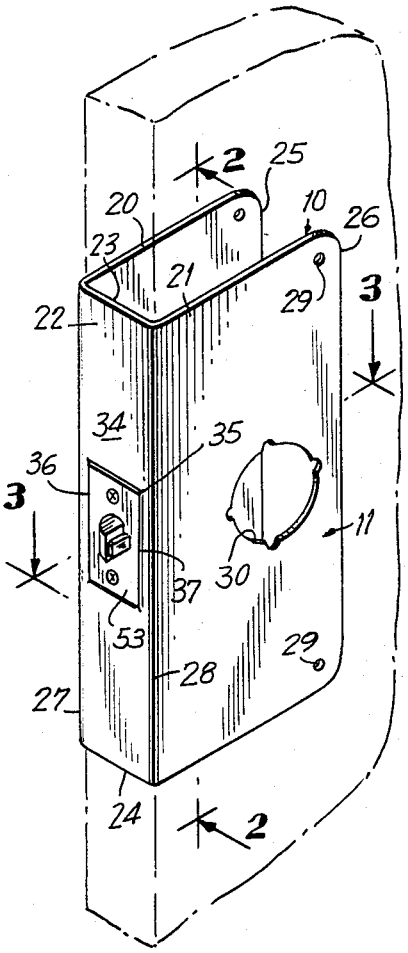
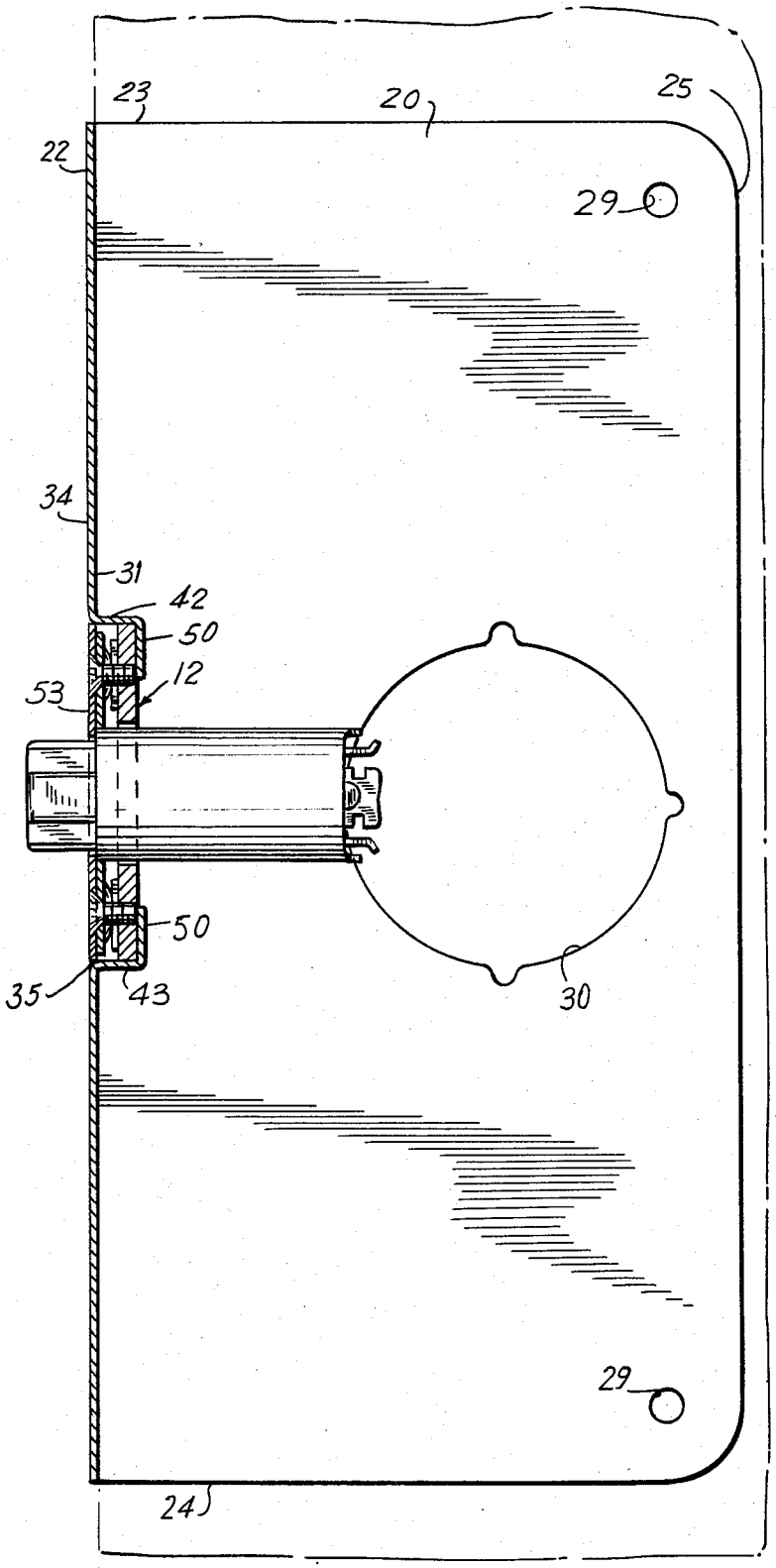
FIG. 2

DOOR LOCK COVER

BACKGROUND OF THE INVENTION

This invention relates generally to the field of door lock covers of a type including a pair of oppositely disposed side walls interconnected by a narrow web which in installed condition overlie the edge of a door in the area of a resiliently mounted latch member. Such devices are particularly useful in the installation of replacement locks which may be of configuration other than the original locks, but may also be used in original lock installation as well. Devices of the general type are well known in the art, and the invention lies in specific constructional details which permit low cost fabrication and the homologation of certain parts for use with doors of different effective widths.

The United States patent to Allenbaugh, U.S. Pat. No. 3,673,605, of June 27, 1972, discloses a typical installation of the instant type, in which the centrally disposed web which overlies the free longitudinal edge of the door is provided with a relieved rectangular area to accommodate the end plate of the lock with which the door is provided. A central opening in the relieved area permits the cylinder housing the latch member to pass therethrough, and a pair of screws interconnects the end plate with threaded openings in the relieved area to fix the location of the end plate. Since the relieved area is formed integrally from the web itself, the screw holes are not very deep, and are not suitable for use with self tapping screws. In some cases, this construction is formed by broaching the holes to provide an axially longer threaded distance prior to the subsequent threading operation.

SUMMARY OF THE INVENTION

Briefly stated, the invention contemplates the provision of an improved door lock cover construction of the type described offering improved ease of manufacture and installation. The web member is formed to include a general rectangular opening to accommodate the end plate of the lock. A smooth inturned flange of metal borders the longitudinal and transverse sides of the opening to provide a neat appearance. In each embodiment, a relatively thick orificed plate member is provided to overlie the opening in the web member and mount the lock plate thereon. The plate includes longitudinal flanges extending laterally from the plane thereof to enter corresponding channels formed by the longitudinally extending flanges bordering the opening in the web to position the plate member. In one embodiment, the plate is maintained in position by bendable tabs extending from the transverse flanges bordering the opening. In a second embodiment, this construction is substituted by screws penetrating the web member and the plate member on either side at the ends thereof. In a third embodiment, the parts are secured by an epoxy adhesive.

BRIEF DESCRIPTION OF THE DRAWING

In the drawing, to which reference will be made in the specification, similar reference characters have been employed to designate corresponding parts throughout the several views.

FIG. 1 is a view in perspective of an embodiment of the invention.

FIG. 2 is a longitudinal central sectional view thereof.

DETAILED DESCRIPTION OF THE DISCLOSED EMBODIMENT

Figure 3:
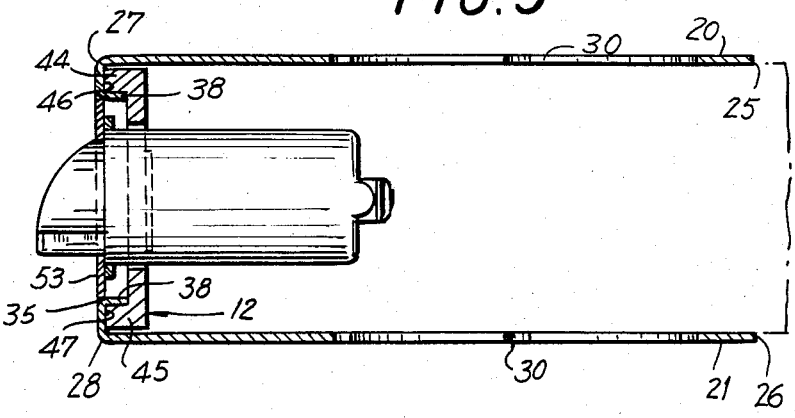
FIG. 3 is a transverse sectional view thereof.
Figure 4:
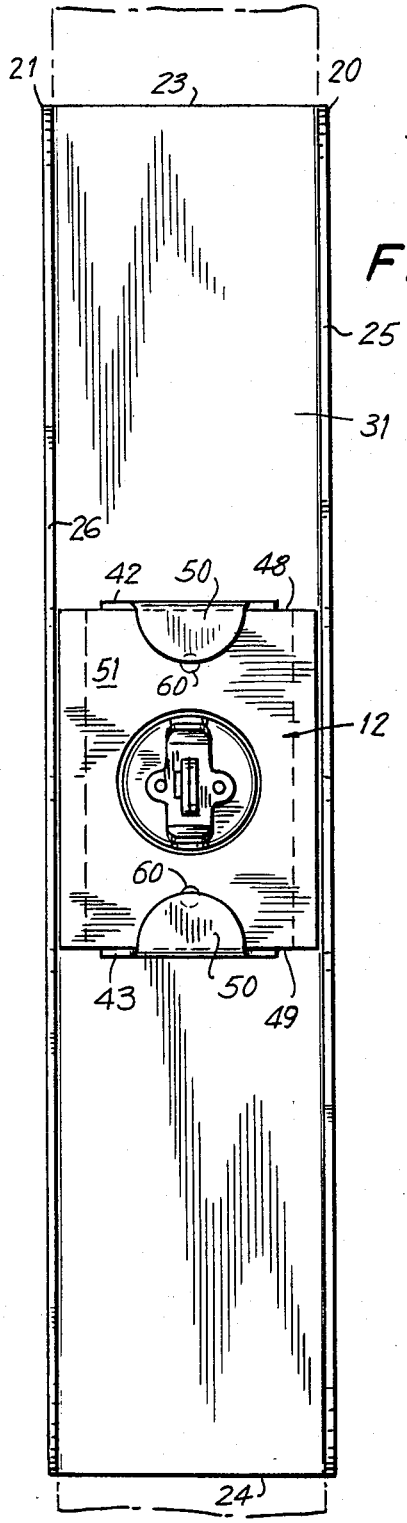
FIG. 4 is a rear elevational view thereof.
Figure 5:
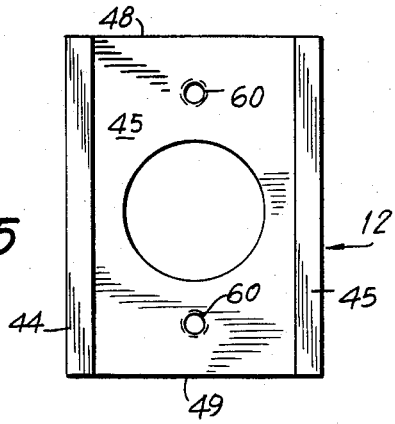
FIG. 5 is an elevational view showing the forward surface of a plate member forming a part of the embodiment.

In accordance with the first embodiment of the invention, the device, generally indicated by reference character 10, comprises broadly: an outer housing element 11, and a plate element 12.

The outer housing element 11 is conventionally formed from a metallic stamping and bent to U-shaped cross section to include first and second side walls 20 and 21 interconnected by a relatively narrow web 22. The element 11 is bounded by a continuous upper edge 23, a continuous lower edge 24, inner edges 25 and 26 and fold edges 27 and 28. Screw holes 28 extend through the walls 20–21 to permit anchorage on a door, although in many cases, the engagement of door knobs through relatively larger openings 30 may suffice. The inner surface 31 of the housing element abuts the inner, outer, and edge surfaces of a door (not shown) in well known manner.

Extending inwardly from the outer surface 34 of the web 22 is a rectangular opening 35 bounded by longitudinal sides 36 and 37 formed by inwardly curved flanges 38, the free edges of which are disposed inwardly of the inner surface 31 of the web. The upper and lower ends of the opening 35 are bounded by flanges 42 and 43.

The plate element 12 is of elongated configuration, and may be formed either by die casting or stamping of relatively soft metal such as aluminum or extruded to be cut to proper length. A pair of longitudinal edge flanges 44 and 45 are adapted to engage channels 46 and 47 formed by the flanges 38. The end edges 48 and 49 on the element 12 are positioned thereby between the flanges 42 and 43 to accurately position the plate element within the opening 35. Tabs 50 may then be bent to substantially a right angle to engage the inner surface 51 thereof and completely anchor the plate element 12 relative to the outer housing element. The outer surface 45 of the plate element is positioned in recessed orientation behind the opening 35 for reception of a lock end plate 53.

Figure 6:
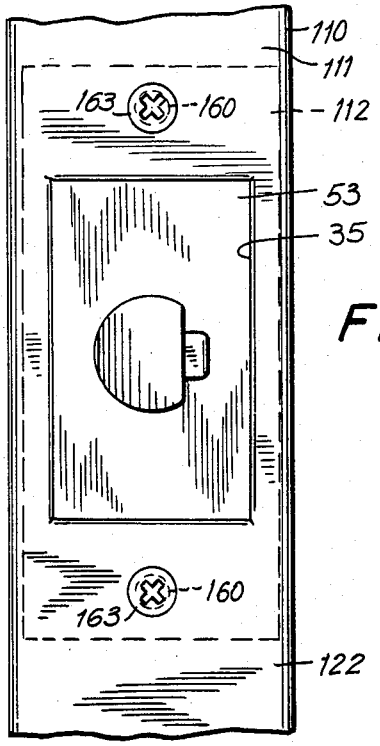
FIG. 6 is an elevational view showing a second embodiment of the invention.

Turning now to the second embodiment of the invention, illustrated in FIG. 6, parts corresponding to those of the principal embodiment have been designated by similar reference characters with the additional prefix "1".

The second embodiment of the invention differs from the first embodiment, principally in the elimination of the bendable tabs on three edges of the transverse flanges bordering the rectangular opening 35. Instead, the plate element 112 is made somewhat longer, and with the elimination of the transverse flanges 42 and 43, the element 12 extends beyond the upper and lower edges of the opening 35. Tapped holes 160 are positioned beneath corresponding holes in the web 122, so that the elements 112 and 113 may be interconnected by screw means 163. In either case, the lock plate is securred by screws which pass through the lock end plate and the element 112 as in the prior art. In each case, owing to the thickness of the element 12, the screws are fastened by a plurality of threads (not shown), rather than the single thread which results when the fastening screw penetrates a thin sheet of metal.

In an alternate embodiment (not illustrated) it is possible to secure the outer housing element 11 and plate element 12 using an epoxy adhesive applied in the channels 46 and 47.

It may thus be seen that we have invented novel and highly useful improvements in lock plate cover devices, in which the device offers increased strength and rigidity as well as durability, with very little increase in production costs as contrasted with prior art devices. Because the device is made in multiple pieces, should any one part, particularly the plate element become damaged, it may be readily replaced at very low cost without the necessity of replacing the entire device. By varying the depth of the laterally extending longitudinal flanges on the plate element, it is possible to vary the depth of the recess in which the lock end plate is disposed, so as to always assure a flush mounting, irrespective of the thickness of the lock end plate. This can also be accomplished using shims in the channels formed by the longitudinally extending flanges on the web. It will also be noted that locks of differing latch conconfiguration or diameter may be accommodated by merely replacing the plate element 12 with another having openings corresponding to the particular latch. Where desired the device can be marketed in kit form with a plurality of plate elements having openings of varying size and location, one of which is selected for an individual installation.

We wish it to be understood that we do not consider the invention limited to the precise details of structure shown and set forth in this specification, for obvious modifications will occur to those skilled in the art to which the invention pertains.

We claim:

1. In a door lock cover for covering the edge and adjacent portions of a door to overlie a lock recessed within said door, the cover including a housing having opposed side walls and an interconnecting web, said web overlying an edge surface of said door, said web having a medially disposed opening therein for the location of an end plate surrounding a latch member of said lock, the improvement comprising: said opening being of rectangular configuration and bounded at the ends thereof by free edges, the longer side edges thereof being formed by integral inwardly bent flanges extending inwardly of said web to points beyond the inner surface thereof; a plate element of elongated planar configuration and having longitudinal edge flanges on either side extending laterally from the plane of said plate element; said flanges on said web-forming channels, said flanges on said plate element being engaged within said channels to position said plate element relative to said web to underlie said opening in said web; and means for anchoring said plate element against longitudinal movement relative to said web.

2. A door lock cover in accordance with claim 1, further characterized in said last mentioned means including bendable tabs on said web engaging surfaces on said plate element.

3. A door lock cover in accordance with claim 1, further characterized in said last mentioned means comprising screws penetrating said web and plate element.

4. A door lock cover in accordance with claim 1, further characterized in said last mentioned means including a settable adhesive.

* * * * *